US006231154B1

(12) United States Patent
Corrigan

(10) Patent No.: US 6,231,154 B1
(45) Date of Patent: May 15, 2001

(54) THERMAL INK JET PRINT HEAD AND TEMPERATURE CONTROL APPARATUS AND METHOD

(75) Inventor: George H. Corrigan, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 19 days.

(21) Appl. No.: 09/651,205

(22) Filed: Aug. 30, 2000

Related U.S. Application Data

(63) Continuation of application No. 08/959,639, filed on Oct. 28, 1997.

(51) Int. Cl.[7] ..... B41J 29/38
(52) U.S. Cl. ..... 347/17
(58) Field of Search ..... 347/14, 17, 19, 347/186

(56) References Cited

U.S. PATENT DOCUMENTS

| | | | | |
|---|---|---|---|---|
| 4,490,728 | * | 12/1984 | Vaught et al. | 346/1.1 |
| 4,791,435 | * | 12/1988 | Smith et al. | 346/146 R |
| 5,109,234 | | 4/1992 | Otis, Jr. et al. . | |
| 5,223,853 | * | 6/1993 | Wysocki et al. | 346/1.1 |
| 5,357,081 | * | 10/1994 | Bohorquez | 219/497 |
| 5,418,558 | * | 5/1995 | Hock et al. | 347/14 |
| 5,428,376 | * | 6/1995 | Wade et al. | 347/14 |
| 5,473,351 | * | 12/1995 | Helterline et al. | 347/19 |
| 5,475,405 | * | 12/1995 | Widder et al. | 347/14 |
| 5,483,265 | * | 1/1996 | Kneezel et al. | 347/14 |
| 5,526,027 | | 6/1996 | Wade et al. . | |
| 5,576,745 | | 11/1996 | Matsubara . | |

FOREIGN PATENT DOCUMENTS

0658429A2 11/1994 (EP) .

* cited by examiner

*Primary Examiner*—Arthur T. Grimley
*Assistant Examiner*—Hoang Ngo

(57) ABSTRACT

A thermal ink jet print head with numerous firing elements on a die, and a temperature sensor on the die with a sensor voltage output proportional to a sensed temperature. A digital to analog converter has a digital input and an output voltage proportional to the value of a digital word received by the digital input, and a comparator has a first input connected to the sensor voltage output and a second input connected to the converter voltage output. The comparator generates an equivalency signal when the converter output voltage exceeds the sensor output voltage. The print head may have a temperature controller that compares the digital word to a preselected temperature threshold value to determine if the temperature is within a selected range, and which changes the temperature of the die in response to a determination that the temperature is outside of the selected range.

20 Claims, 2 Drawing Sheets

THERMAL INK JET PRINT HEAD AND TEMPERATURE CONTROL APPARATUS AND METHOD

CROSS REFERENCE TO RELATED APPLICATION(S)

This is a continuation of application Ser. No. 08/959,639 filed on Oct. 28, 1997.

FIELD OF THE INVENTION

This invention relates to thermal ink jet printers, and more particularly to the control of print head temperature.

BACKGROUND AND SUMMARY OF THE INVENTION

Ink jet printing mechanisms use pens that shoot droplets of colorant onto a printable surface to generate an image. Such mechanisms may be used in a wide variety of applications, including computer printers, plotters, copiers, and facsimile machines. For convenience, the concepts of the invention are discussed in the context of a printer. An ink jet printer typically includes a print head having a multitude of independently addressable firing units located on a silicon die, along with connecting circuitry. Each firing unit includes an ink chamber connected to a common ink source, and to an ink outlet nozzle. A transducer within the chamber provides the impetus for expelling ink droplets through the nozzles. In thermal ink jet printers, the transducers are thin film firing resistors that generate sufficient heat during application of a brief voltage pulse to vaporize a quantity of ink sufficient to expel a liquid droplet.

Its it important to maintain a controlled temperature of the die in thermal ink jet printers. Below a normal operating temperature, resistor firing characteristics are affected, and ink viscosity impairs normal fluid flow. Consequently, overall printing performance and uniformity are impaired, and thermal control is required. Thermal control is also required to detect excessive pen temperatures, such as may occur in cases in which extremely demanding continued printing occurs at high speed, or when a depletion of the ink supply goes undetected. Such excessive temperatures may cause a catastrophic pen failure due to thermal runaway, requiring costly component replacement or service.

Existing ink jet printers monitor die temperature by use of a thin film sensor resistor on the die. The printer is connected to the sensor resistor via a line on the interconnect set used also to provide power and printing data to the die. The printer circuitry includes what is essentially a digital ohmmeter that reads the resistance of the sensor resistor, and infers the resistor temperature based upon the principle that resistance is proportional to temperature. This system has limited accuracy because the sensor resistor provides only a weak analog signal voltage that changes only slightly in response to temperature, with a voltage change of 5 mV/° C. being typical. This a particular concern because the numerous other lines of the interconnect and flex circuit connecting the printer to the die are very electrically noisy, with currents of up to 8 A undergoing high speed hard switching during normal printer operations. Thus, the relatively faint voltage indicating temperature may be distorted or lost in the EFI noise generated during printing. In addition, the printer operations to measure the die temperature may require additional computing overhead, which may slow or divert controller resources from the printing operation.

The present invention overcomes the limitations of the prior art by providing a thermal ink jet print head with numerous firing elements on a die, and a temperature sensor on the die with a sensor voltage output proportional to a sensed temperature. A digital to analog converter has a digital input and an output voltage proportional to the value of a digital word received by the digital input, and a comparator has a first input connected to the sensor voltage output and a second input connected to the converter voltage output. The comparator generates an equivalency signal when the converter output voltage exceeds the sensor output voltage. The print head may have a temperature controller that compares the digital word to a preselected temperature threshold value to determine if the temperature is within a selected range, and which changes the temperature of the die in response to a determination that the temperature is outside of the selected range.

DETAILED DESCRIPTION OF A PREFERRED EMBODIMENT

Figure 1:
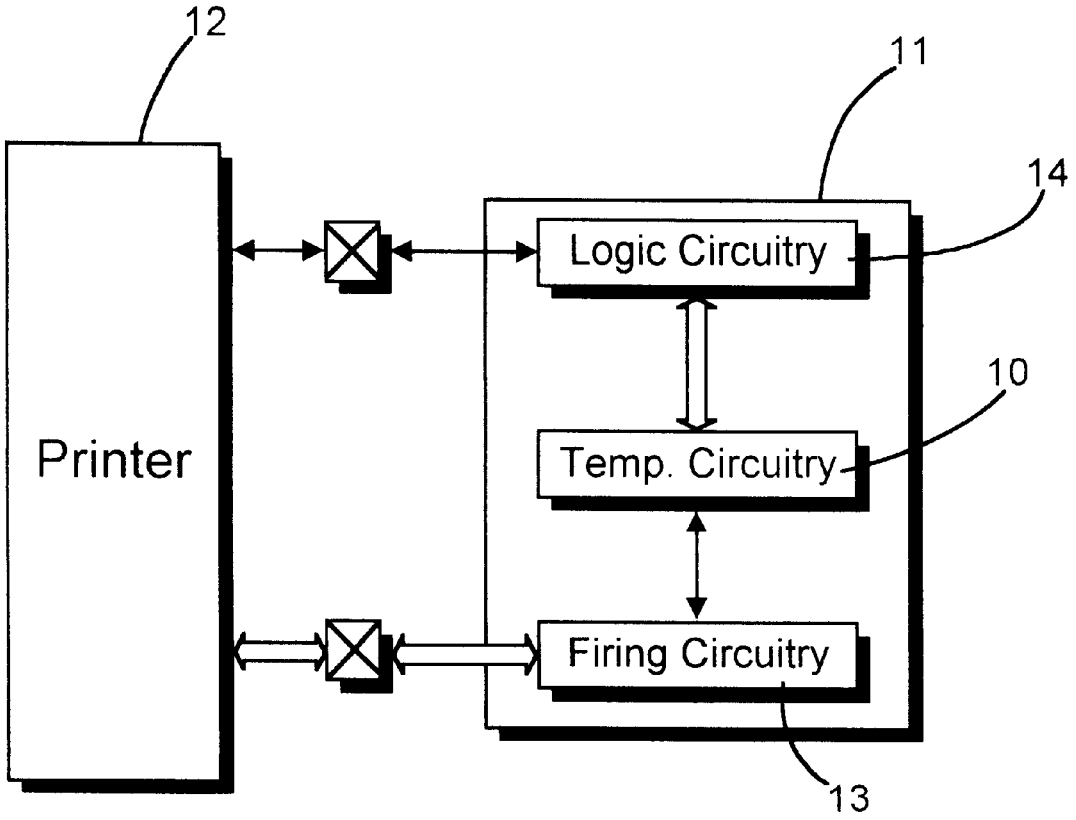
FIG. 1 is a schematic block diagram of a printing system according to a preferred embodiment of the invention.

FIG. 1 shows a temperature measurement and control circuit 10 residing on a die 11 of a thermal ink jet print head that is removable from a printer 12. The die includes firing circuitry 13 having an array of conventional ink jet firing resistors that are multiplexed and connected to the printer electronics over a multi line bus, and logic control circuitry 14 that connects to the various elements of the temperature circuitry 10 and of the firing circuitry 13, and which connects to the printer by a single serial data command line.

Figure 2:
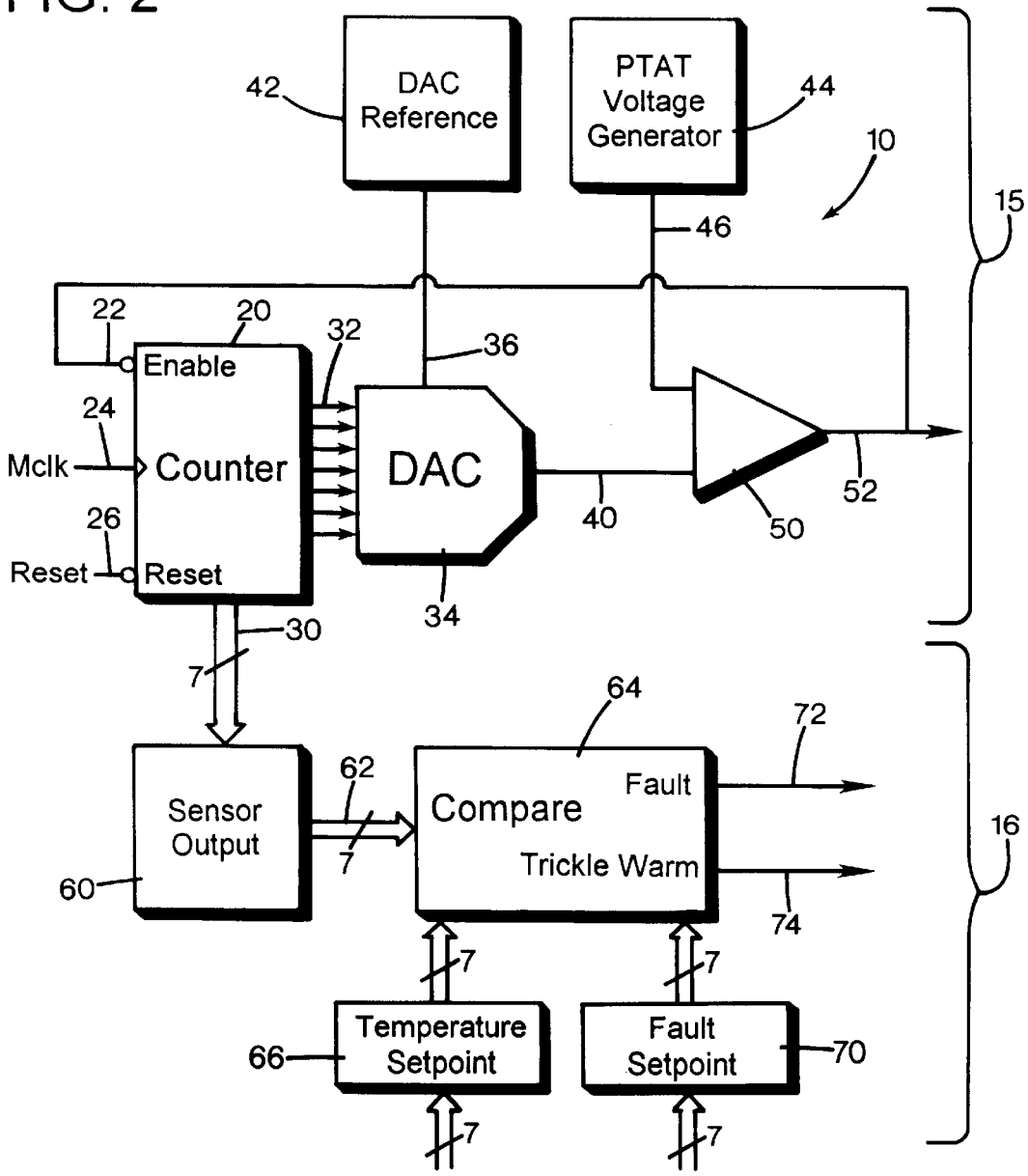
FIG. 2 is a schematic block diagram of a thermal ink jet temperature measurement and control circuit of the embodiment of FIG. 1.

As shown in FIG. 2, the temperature circuitry 10 includes a measurement section 15 and a control section 16. The measurement section includes a digital counter 20 having an enable input 22, a clock input 24, and a reset input 26. The counter has a seven bit output bus 30, and a seven bit control bus 32. The counter is operable to generate a seven bit digital word in an internal register that increments in response to pulses received on the clock line 24 while the enable line is held low. When the enable signal is high, the register contents are held constant. When the reset line 26 is pulsed, the counter register is cleared to zero. The register contents are expressed as high or low logic states on the respective lines of the output busses 30, 32.

The counter's control bus is connected to the inputs of a digital to analog converter (DAC) 34, which has an analog reference voltage input line 36, and an analog voltage output line 40. The DAC generates an output voltage that is proportional to the voltage on the input line 36 and to the value of the digital word received at the control bus 32. When the control bus receives all zeros, the output voltage is half of the reference voltage __, and when the control bus receives all ones, the output voltage is equal to the reference voltage on line 36. A reference voltage generator 42 generates the reference voltage, and includes conventional circuitry to maintain a stable voltage regardless of temperature variations or manufacturing process variations. In the preferred embodiment, the reference voltage is 5.12V+/−0.1V.

The measurement section 14 includes a voltage generator 44 on the die that generates a measurement voltage on line 46. The measurement voltage is proportional to the absolute temperature of the die, and has a substantially linear output voltage relative to temperature. In the preferred embodiment, the measurement voltage is equal to 2.7V+(10 mV×T), with the temperature expressed in degrees Celsius, so that the voltage is 2.7V at the freezing point of water, for instance.

A voltage comparator 50 has a first input connected to the DAC output voltage line 40, and a second input connected to the voltage generator output 46. When the voltage of the DAC exceeds the measurement voltage on line 46, the comparator will express a logic high on a converter output line 52, which is connected to control logic circuitry and to the counter's enable line 22.

The temperature sensing circuitry may operate continuously and independently of printing operations on the same die 12. In operation, when the print head is first installed in a printer, or when the printer is first powered on, the counter is reset to zero for a temperature measurement to begin. With the digital word zero transmitted to the DAC, the comparator evaluates whether the DAC 34 output exceeds the output of the voltage generator 50. If so, the converter output switches to high, signaling to logic circuitry that a measurement is complete, and disabling the counter from further incrementing by transmitting this voltage to the enable input 22. If the DAC voltage is below the temperature measurement voltage, the comparator output remains low, keeping the counter in an enabled state. In this state, the counter responds to the next clock pulse by incrementing the digital word in its register by a single bit. In response to this, the DAC output voltage is incremented by a step, and the comparator evaluates if the increased DAC output exceeds the measurement voltage. The incrementing process continues upward until the DAC voltage first exceeds the measurement voltage. When this occurs, the converter output switches to high, signaling to logic circuitry that a measurement is complete, and disabling the counter from further incrementing by transmitting this voltage to the enable input 22. If the DAC voltage never exceeds the measurement voltage, such as might occur in a thermal runaway condition, then.

In normal circumstances, when the DAC voltage has just exceeded the measurement voltage, the counter register will contain and maintain the digital word corresponding to the temperature level of the die. After this encoded temperature value is read from the counter, the logic circuitry may reset the counter so that another measurement may begin.

The temperature control section 14 of the circuit 16 serves to read the calculated temperature value code from the counter, to determine if it is within a preselected range, and to warm the die if too cold, or to disable or slow the printing operations if the temperature is too high. The control section includes a sensor output register 60 connected to the output bus 30 to receive and store the digital word received from the counter. The register 60 has an output bus 62 connected to a digital comparator circuit 64. The register is connected to the logic circuitry so that the logic circuitry may initiate storage of the digital word when the "measurement complete" signal is received from the converter 50, and so that the counter may be reset and reenabled after the word has been stored in register 60.

The comparator 64 has three input busses: bus 62, plus second and third busses connected respectively to a low temperature setpoint register 66, and to a fault setpoint register 70. Each setpoint register is connected to logic circuitry on the die that receives setpoint data from the printer over the serial command line. The setpoint values are seven bit digital words that are encoded on the same scale as the measured temperature data. The low temperature setpoint value corresponds to the minimum acceptable operating temperature, below which the die is considered not warmed up. The fault temperature setpoint value corresponds to the maximum acceptable operating temperature, above which the die is considered too hot to operate safely or reliably.

The comparator has a fault output line 72 that connects to logic circuitry, and which is set low when the value of the sensor output word is less than the value of the fault setpoint value, and is set high when the value of the sensor output word is greater than the value of the fault setpoint value. A trickle warm output line 74 from the comparator also connects to logic circuitry, and is set low when the value of the sensor output word is greater than the value of the temperature setpoint value, and high when the value of the sensor output word is less than the value of the temperature setpoint value.

Logic circuitry responds to a low signal from both outputs 72, 74 with normal operation. If logic circuitry detects a high level on the fault line, it signals the printer via the command line either to stop printing and display a fault message, or to slow printing to reduce heat accumulation. The logic circuitry may also connect directly to the firing circuitry 13 to provide on-die disablement capabilities in the event of printer error. If logic circuitry detects a high level on the trickle warm line, it activates warming circuitry on the die that continues to warm the die until the trickle warm signal drop low in response to the measured temperature dropping below the selected setpoint. Printing is deferred or suspended until warming is complete.

In normal operation, the temperature will be below the low setpoint when the printer is first turned on, so that trickle warming will occur for multiple temperature measurement cycles until the setpoint is reached. With the printer on and idle, the trickle warming will cycle on as the die temperature drops below the setpoint, and off as die temperature exceeds the setpoint, maintaining a temperature within a narrow range that is no wider than required for proper printing, due to the continuous and rapid measurement cycling. When printing begins, the die warms from normal operation, making further trickle warming unnecessary, unless the printer becomes idle or is printing a very sparse pattern firing few nozzles. If printing is heavy, with most or all nozzles firing for a prolonged period, the die temperature may reach the fault threshold, and printing may be slowed, or interrupted until the die temperature drops below the fault level, or halted altogether.

To provide additional control, the comparator 64 may evaluate the magnitude by which the measures voltage word departs from the desired range, and take action of varying magnitude accordingly. A slight exceeding of the fault setpoint may initiate slowed printing, while a greater margin of departure causes printing to halt. Similarly, at the lower setpoint, a faster rate of warming may be provided until a first temperature is reached, and a slower trickle rate until a higher temperature is reached. These features require the output lines 72, 74 to be multi bit busses.

In the preferred embodiment, the system has a sensing range from 0° C. to 120° C., and a nominal conversion time of about 40 nS for 40° C. at 4 MHz clock frequency. The DAC is a 128 element precision polysilicon strip with 127 taps. Each tap is routed through a series of analog switches controlled by a decoded version of the input word. The reference voltage is derived from a bandgap reference, and varies by only +/−4% over possible permutations of process and operating temperatures. The DAC has an offset of 2.56V to ease design constraints on the sensor and comparator circuits, and has a resolution of 20 mV per increment, which yields a temperature resolution of +/−2° C., and 2° C. per count in the output register.

While the above is discussed in terms of preferred and alternative embodiments, the invention is not intended to be so limited.

What is claimed is:

1. A thermal ink jet printing apparatus comprising:

a die;

plurality of firing elements on the die;

a temperature sensor on the die having a sensor output line expressing a sensor output voltage proportional to a sensed temperature;

a digital to analog converter on the die having a digital input and a converter output expressing a converter output voltage proportional to the value of a digital word received by the digital input; and a first comparator on the die having a first input connected to the sensor output line and a second input connected to the converter output line, and having a comparator output operable to generate an equivalency signal in response the converter output voltage exceeding the sensor output voltage.

2. The apparatus of claim 1 including means for transmitting the digital word to temperature control circuitry on the die.

3. The apparatus of claim 1 including a feedback loop connecting the comparator output to the digital to analog converter.

4. The apparatus of claim 3 wherein the feedback loop connects via incrementing means for incrementing the digital word.

5. The apparatus of claim 1 wherein the comparator output is operably connected to word transmission means responsive to the equivalency signal to transmit the digital word to a storage device.

6. A method of controlling the temperature of a printing die of a thermal ink jet printer comprising the steps:

generating a measurement voltage based on a temperature of the die;

sequentially generating a plurality of different digital words;

converting each digital word to an associated reference voltage;

comparing each reference voltage to the measurement voltage; and identifying a selected reference voltage approximating the measurement voltage.

7. The method of claim 6 including transmitting the digital word associated with the selected reference voltage to temperature control circuitry on the die.

8. The method of claim 7 including comparing the digital word with a preselected digital temperature threshold value.

9. The method of claim 8 including determining the difference between the digital word and the digital temperature threshold value.

10. The method of claim 8 including activating a warming element on the die in response to an under temperature condition in which the digital word is less than the preselected value.

11. The method of claim 8 including preventing printing in response to an over temperature condition in which the digital word is less than the preselected value.

12. The method of claim 6 including storing the digital word associated with the selected reference voltage.

13. The method of claim 6 wherein sequentially generating a plurality of different digital words includes receiving an output signal based on the step of comparing each reference voltage to the measurement voltage.

14. The method of claim 6 wherein sequentially generating a plurality of different digital words includes sequentially changing the digital word.

15. The method of claim 14 wherein sequentially changing the digital word includes changing the reference voltage to a value closer to the measurement voltage.

16. A thermal ink jet printing apparatus comprising:

a die;

plurality of firing elements on the die;

a temperature sensor on the die having a sensor output line expressing a sensor output voltage proportional to a sensed temperature;

a digital to analog converter having a digital input and a converter output line expressing a converter output voltage proportional to the value of a digital word received by the digital input;

a first comparator having a first input connected to the sensor output line and a second input connected to the converter output line, and operable to generate an equivalency signal in response the converter output voltage exceeding the sensor output voltage; and a circuit element having an output connected to the converter digital input and operable to change the digital word.

17. The apparatus of claim 16 including temperature control means for comparing the digital word to a preselected temperature threshold value to determine if the temperature is within a selected range, and for changing the temperature of the die in response to a determination that the temperature is outside of the selected range.

18. The apparatus of claim 17 including a reference voltage connected to the converter.

19. The apparatus of claim 17 wherein the digital to analog converter is on the die.

20. The apparatus of claim 17 wherein the entire circuit is on the die.

* * * * *

UNITED STATES PATENT AND TRADEMARK OFFICE

CERTIFICATE OF CORRECTION

PATENT NO. : 6,231,154 B1
DATED : May 15, 2001
INVENTOR(S) : Corrigan

It is certified that error appears in the above-identified patent and that said Letters Patent is hereby corrected as shown below:

Column 2,
Line 56, delete “voltate _,” and insert therefor -- voltage, --.
Line 63, delete “14” and insert therefor -- 15 --.

Column 3,
Line 36, delete “If the DAC voltage never exceeds the measurement”.
Line 37, please delete the entire line.
Line 38, please delete the entire line.

Column 5,
Line 24, after “response”, insert -- to --.

Column 6,
Line 38, after “response”, insert -- to --.

Signed and Sealed this

Eleventh Day of May, 2004

JON W. DUDAS
*Acting Director of the United States Patent and Trademark Office*